US012330033B2

(12) United States Patent
Cather et al.

(10) Patent No.: US 12,330,033 B2
(45) Date of Patent: Jun. 17, 2025

(54) BASEBALL BAT COLLAR

(71) Applicant: Shot Collar LLC, Roswell, GA (US)

(72) Inventors: Michael Cather, Roswell, GA (US); James Atticus Ferguson, Atlanta, GA (US); Collin Gaddes, Huntsville, AL (US)

(73) Assignee: Shot Collar LLC, Roswell, GA (US)

( * ) Notice: Subject to any disclaimer, the term of this patent is extended or adjusted under 35 U.S.C. 154(b) by 231 days.

(21) Appl. No.: 18/061,962

(22) Filed: Dec. 5, 2022

(65) Prior Publication Data

US 2023/0321509 A1 Oct. 12, 2023

Related U.S. Application Data

(60) Provisional application No. 63/327,846, filed on Apr. 6, 2022.

(51) Int. Cl.
*A63B 69/00* (2006.01)
*A63B 60/24* (2015.01)

(52) U.S. Cl.
CPC ..... *A63B 69/0002* (2013.01); *A63B 60/24* (2015.10); *A63B 2069/0006* (2013.01)

(58) Field of Classification Search
CPC ..... A63B 69/0002; A63B 2069/0006; A63B 60/24
USPC ..... 473/437, 451
See application file for complete search history.

(56) References Cited

U.S. PATENT DOCUMENTS

| | | | | |
|---|---|---|---|---|
| 4,260,150 | A | 4/1981 | Tabet | |
| 5,024,436 | A | 6/1991 | Vento | |
| 5,050,877 | A | 9/1991 | Wales | |
| 5,133,213 | A | 7/1992 | Bernstein et al. | |
| D337,801 | S | 7/1993 | Tandberg | |
| D414,405 | S | 9/1999 | Tompkins | |
| 5,980,397 | A | 11/1999 | Hart et al. | |
| 6,533,685 | B1 | 3/2003 | Otten et al. | |
| 7,048,640 | B2 * | 5/2006 | Light | A63B 69/3638 473/226 |
| 7,128,667 | B2 | 10/2006 | Nolan | |
| 7,344,457 | B2 | 3/2008 | Liberatore | |
| 7,686,711 | B2 * | 3/2010 | Miller | A63B 69/0002 473/422 |
| D627,841 | S | 11/2010 | Estrada, Jr. et al. | |
| 8,231,484 | B1 | 7/2012 | Quinn | |
| 8,419,562 | B2 * | 4/2013 | Marrero | A63B 69/3638 473/226 |

(Continued)

OTHER PUBLICATIONS

U.S. Appl. No. 29/855,914, filed Oct. 7, 2022, Michael Cather et al.

(Continued)

*Primary Examiner* — Mitra Aryanpour
(74) *Attorney, Agent, or Firm* — BEKIARES ELIEZER LLP

(57) ABSTRACT

The present application relates to a weighted bat sleeve system that can be easily detached from the barrel of a bat used for sports such as baseball and softball. The system comprises a plurality of panels and a collar to secure the system to the barrel of a baseball bat. In some embodiments, the system may be configured to allow the weight of the system to be adjusted or for sensors to be incorporated into the system to capture and collect data relating to the system.

20 Claims, 12 Drawing Sheets

(56) References Cited

U.S. PATENT DOCUMENTS

| | | | | |
|---|---|---|---|---|
| D703,283 | S | 4/2014 | Livingston | |
| 8,944,943 | B2 * | 2/2015 | Heiberg | A63B 59/50 473/568 |
| 9,610,486 | B2 | 4/2017 | Deggs | |
| D854,636 | S | 7/2019 | Nelson | |
| 10,737,160 | B1 | 8/2020 | Beyer | |
| D900,946 | S | 11/2020 | Muir | |
| D905,805 | S | 12/2020 | Muir et al. | |
| D950,656 | S | 5/2022 | Andersson | |
| D958,272 | S | 7/2022 | Leclair | |
| 11,471,740 | B1 * | 10/2022 | Jamison | A63B 69/3638 |
| D979,677 | S | 2/2023 | Liu | |
| D990,303 | S | 6/2023 | Dillehay et al. | |
| D1,001,928 | S | 10/2023 | Jones | |
| D1,014,215 | S | 2/2024 | Zhao | |
| D1,026,126 | S | 5/2024 | Zhang | |
| D1,029,148 | S | 5/2024 | Jones | |
| 2005/0277491 | A1 | 12/2005 | Nolan | |
| 2009/0181812 | A1 | 7/2009 | Miller | |
| 2010/0137078 | A1 | 6/2010 | Liberatore | |
| 2014/0213422 | A1 | 7/2014 | Marcus | |
| 2018/0178101 | A1 | 6/2018 | Francis | |
| 2023/0321509 | A1 * | 10/2023 | Cather | A63B 60/02 473/451 |

OTHER PUBLICATIONS

International Search Report and Written Opinion mailed Jul. 10, 2023 cited in Application No. PCT/US23/64390, 5 pgs.

U.S. Non-Final Offie Action dated Sep. 20, 2024 cited in U.S. Appl. No. 29/855,914, 15 pgs.

"Varo ARC Bat Training Weight", posted to Amazon Nov. 3, 2016, retrieved: Sep. 19, 2024; https://www.amazon.com/dp/B01M5K8M1V/ref=sspa_dk_detail_0?pd_rd_i=B01M5K8M1V&pd_rd_w=LaFVo&content-id=amzn1.sym.953c7d66-4120-4d22-a777-f19bdfa69309&pf_rd_p=953c7d66-412dd-a777-f19dbfa69309&pf_rd_r=Q0.

"GorillaJaw Olympic Barbell Clamps", posted to Amazon Mar. 7, 2021; retrieved from Internet Sep. 19, 2024; https://www.amazon.com/GorillaJaw-Olympic-Barbell-Weightlifting-Exercise/dp/B08Y85C44D/ref=asc_df_B08Y85C44D/?tag=hyprod-20&linkCode=df0&hvadid=692875362841&hvpos=&hvnetw=g&hvrand=3-71485240231009640&.

* cited by examiner

FIG. 7A
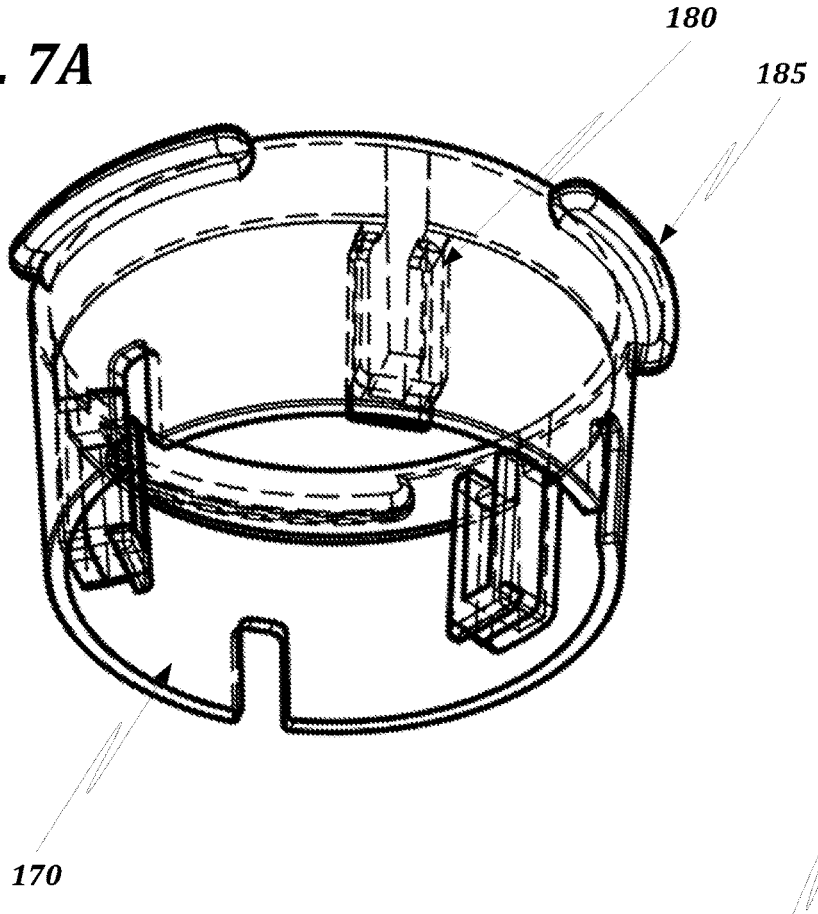
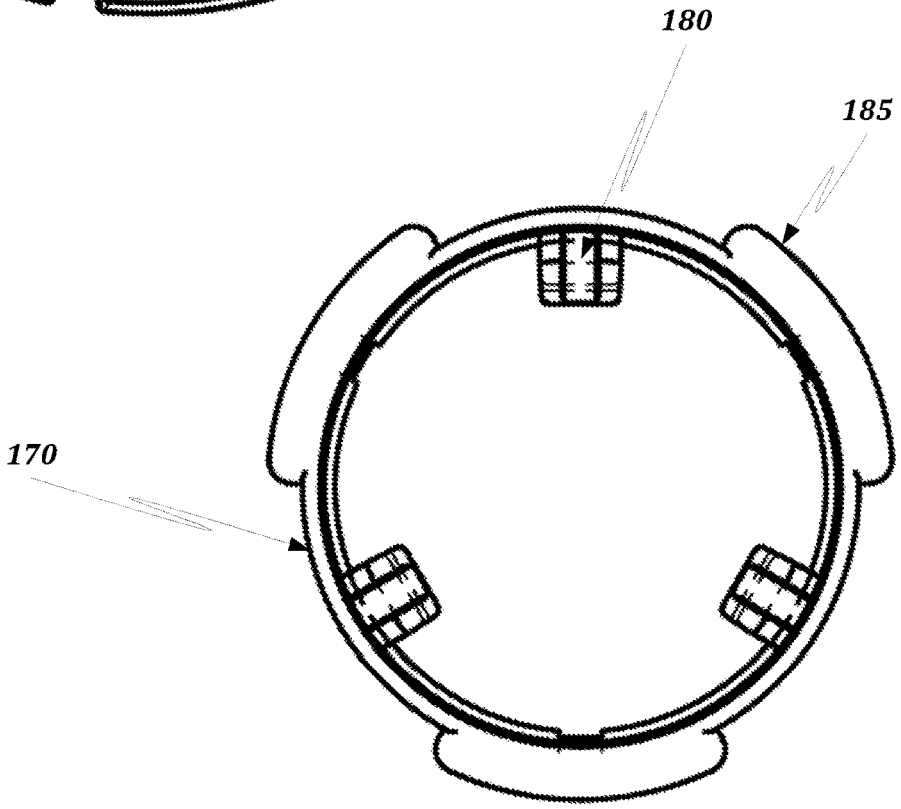
FIG. 7B

FIG. 8A
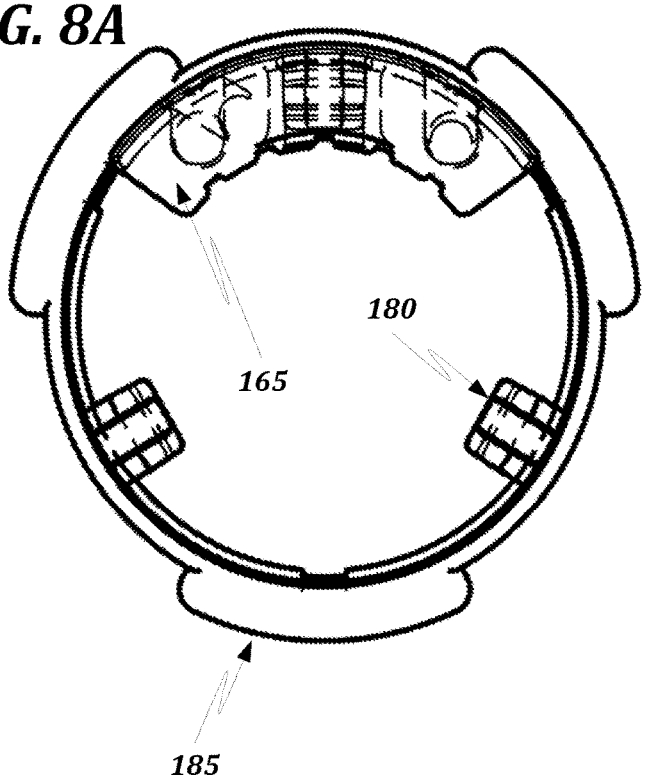
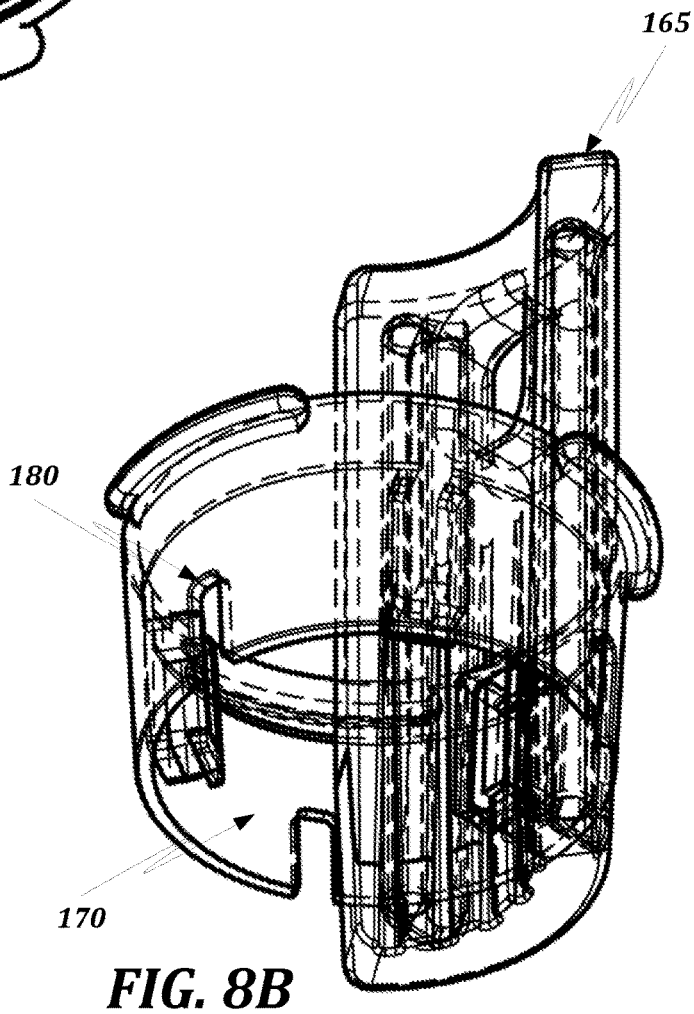
FIG. 8B

FIG. 9A
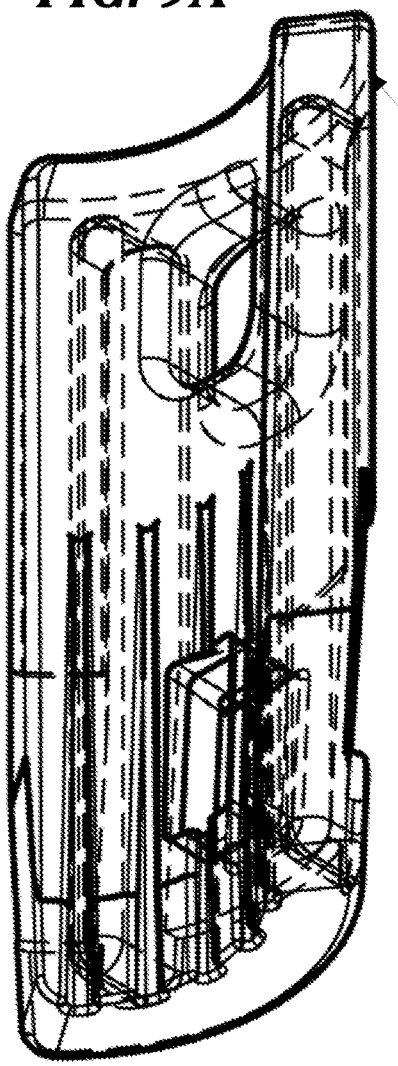
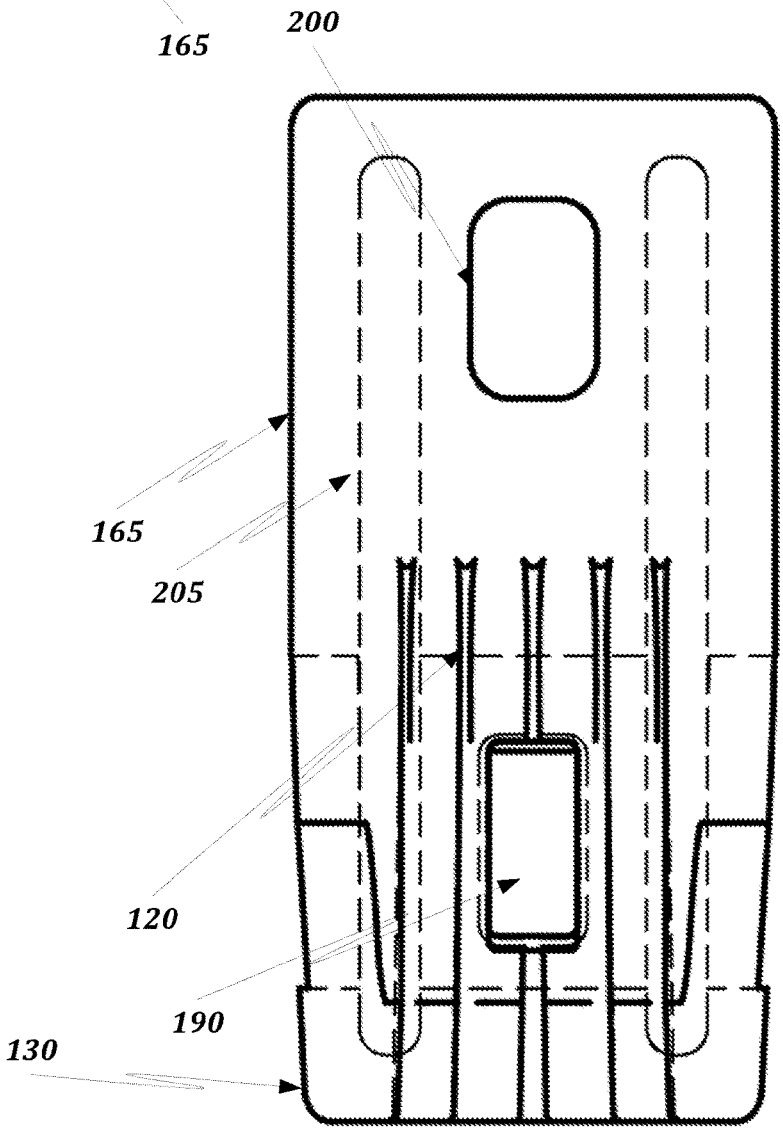
FIG. 9B

BASEBALL BAT COLLAR

RELATED APPLICATIONS

Under provisions of 35 U.S.C. § 119(e), the Applicant claims benefit of U.S. Provisional Application No. 63/327,846, filed on Apr. 6, 2022, and is related to U.S. Design application No. 29/855,914 filed on Oct. 7, 2022, having inventors in common, which are incorporated herein by reference in its entirety.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to a bat collar. More particularly a quick release weighted bat sleeve with removeable weights used for practicing batting swings in sports that utilize bats, such as baseball and softball.

BACKGROUND

Bat weights are commonly used to make an unweighted bat feel lighter and easier to handle after the bat weight has been removed. The bat weight may take the form of a collar or sleeve that fits around the bat. For example, bat weights commonly use the difference in diameter between the handle of a bat and the barrel of the bat to secure the bat weight to the barrel of the bat through static friction resulting from placing the bat weight onto the barrel of the bat and the centripetal force generated by swinging the bat with the bat weight on the barrel, essentially wedging the bat weight to the barrel of the bat. In some situations, the large contact surface between the barrel of the bat and the bat weight can result in cosmetic or even minor structural damage to the bat that the bat weight is used on. To remove the bat weight from the barrel, a user must strike the handle of the bat on the ground, sending an impulse of force through the bat in an attempt to separate the bat weight from the barrel.

Recently two-piece bats, where the handle and the barrel of the bat are independent modules connected together using epoxy, glue, and/or other chemical or mechanical fasteners, have become more popular. The conventional means of removing a bat weight by striking the handle on the ground not only applies a force to the barrel of the bat, but also the mechanism used to connect the barrel to the handle. In certain situations, the force required to separate the bat weight from the barrel can be great enough to break, or weaken over time, the connection mechanism between the barrel and the handle. Accordingly, using and removing a conventional bat weight can ultimately destroy the bat, rendering it unusable and unfixable.

Moreover, users of different statures, ages, or physical abilities may require or desire different weights. Additionally, differing weights may be useful as part of a training regime. Traditional bat weights are a single weighted piece, meaning that the only way to have different weights for use was to purchase multiple bat collars, each having a unique weights.

Accordingly, there is a need for a bat collar that is easily removable without causing damage to the bat on which the collar is used. Moreover, there is a need for an adjustably-weighted bat collar.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

The system of the present disclosure may comprise an annular collar, and a plurality of panels. The annular collar may comprise a plurality of protrusions extending radially inwardly from an interior surface of the collar. The plurality of panels may be attached to the collar, wherein the interior of the plurality of panels define a center opening. The plurality of panels may comprise: an external slot configured to releasably secure a weighted insert to the panel; and an opening configured to receive a protrusion, of the plurality of protrusions, such that an interior portion of the protrusion is substantially flush with an interior surface of the panel. The collar is configured to restrict movement of the plurality of panels relative to one another when an object is inserted along the axis of the center opening of the system. The interior surfaces of the plurality of panels are configured to contact and retain the object by a friction fit. The protrusion is configured to separate the panel from the object in response to an orthogonal rotation of the collar relative to the axis of the center opening.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings:

FIG. 7A is a perspective view of the collar;
FIG. 7B is a top view of the collar;

FIG. 8A is a top view of the collar with one of the plurality of panels attached to the collar;

FIG. 8B is a perspective view of the collar with one panel attached;

FIG. 9A is a perspective view of one panel;

FIG. 9B is a front view of the panel;

DETAILED DESCRIPTION

Figure 1:
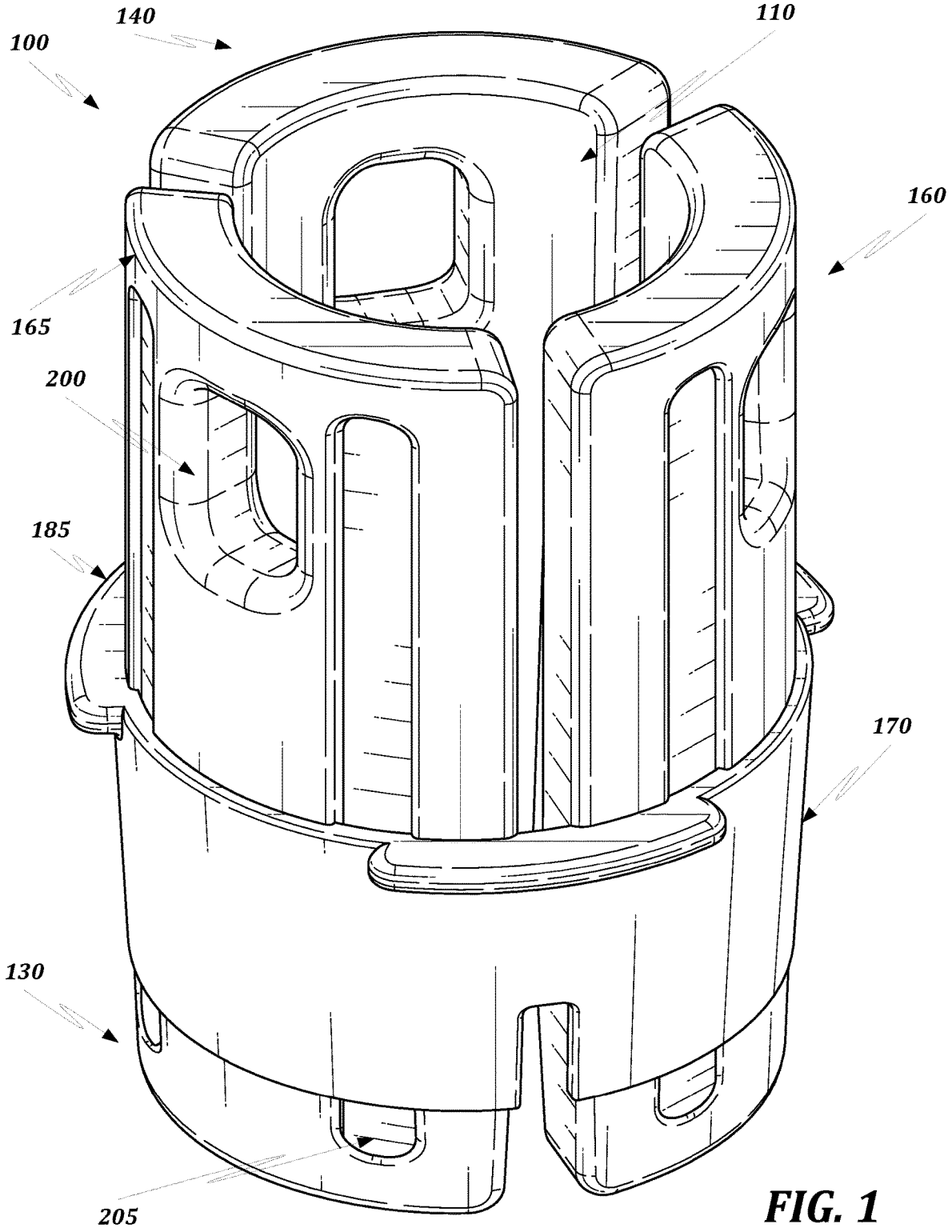
FIG. 1 is a perspective view of a Baseball Bat Collar.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of baseball bat collars, embodiments of the present disclosure are not limited to use only in this context.

I. APPARATUS OVERVIEW

This overview is provided to introduce a selection of concepts in a simplified form that are further described below. This overview is not intended to identify key features or essential features of the claimed subject matter. Nor is this overview intended to be used to limit the claimed subject matter's scope.

Weighted bat sleeves are commonly used for practice swings before batting in baseball, softball, and other batting sports. The system 100 of the present application discloses a multi-piece weighted bat sleeve that can be quickly removed from the barrel of a bat. Applicant's system 100 eliminates the possibility of damaging the bat when removing conventional weighted bat sleeves by striking the handle of the bat onto the ground, sending an impulse force through the handle of the bat. Alternatively, the disclosed system 100 may utilize a collar 170 to secure the weighted bat sleeve to the barrel of the bat that can by released from the barrel with a twisting motion of the system 100. While the system 100 may be initially secured to the barrel of the bat through a force applied along the vertical axis of the bat, orthogonal motion of the system 100 disengages the contact surface such that the system 100 can be removed from the barrel of the bat without the use of percussive force.

Embodiments of the present disclosure may comprise methods, systems, and components comprising, but not limited to, at least one of the following:

A. A Plurality of Panels;

B. An Annular Collar;

In some embodiments, the present disclosure may provide an additional set of components for further facilitating the system 100. The additional set of components may comprise, but not be limited to:

C. A Weighted Insert;

D. A Slot Cover;

E. A Computer Sensing Device;

The following depicts an example of a method of a plurality of methods that may be performed by at least one of the aforementioned components. Various hardware components may be used at the various stages of operations disclosed with reference to each component. For example, although methods may be described to be performed by a single apparatus, it should be understood that, in some embodiments, different operations may be performed by different apparatuses in operating in conjunction with each other. For example, the weighted bat sleeve may be employed in the performance of some or all of the stages disclosed with regard to the methods. Similarly, one apparatus may be employed in the performance of some or all of the stages of the methods. As such, the apparatus may comprise at least one of the architectural components disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Consistent with embodiments of the present disclosure, a method may be performed by at least one of the aforementioned components. The method may comprise the following stages:

Inserting a bat into a center opening 110 of a weighted bat sleeve system 100; Applying a force to the system 100 along an axis of the bat, in a direction from the handle to the cap of the bat, such that a collar 170 of the system mechanically attaches to the barrel of the bat;

Optionally swinging the bat and the system 100;

Applying a force orthogonal to the axis defined by the center opening 110 of the system 100 such that the collar 170 disengages the mechanical attachment to from the barrel of the bat; and Removing the bat from the center opening 110 of the weight bat sleeve system 100 in response to disengagement of the mechanical attachment to the barrel of the bat.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

II. SYSTEM CONFIGURATION

Embodiments of the present disclosure provide a system 100 for attaching to a bat to aid in warm up or training. As shown in FIGS. 1-6, the system 100 may include an annular collar 170 and a plurality of panels 160 attached to an inner surface of the collar to define a center opening 110.

The system 100 may be initially secured to the barrel of a baseball bat or other similar bat by sliding the system 100 over the handle of the bat and applying a small force to the system 100, thereby engaging at least a portion of inner surfaces 115 of the plurality of panels 160, and bringing the inner surfaces into contact with the bat. Alternatively or additionally, centripetal force generated by swinging the bat with the system 100 placed onto the barrel may secure or provide additional force to secure the system 100 to the barrel of the bat.

The system 100 may be configured to expand to attach to the barrel of the bat. In one example, the center opening 110 may be smaller than the barrel diameter of the bat. As the system 100 reaches the barrel portion of the bat, the system 100 may be configured to increase the size (e.g., by compression, dilation, and/or movement of one or more of the plurality of panels 160) such that the center opening 110 accommodates the barrel diameter of the bat. The system 100 may adhere to the bat via a friction fit, but the fit may be such that an impulse force is not required to separate the system 100 from the barrel of the bat. In some embodiments of the present disclosure, the center opening 110 may expand to at least two and five eights inches internal diameter, a common diameter for the barrel of a baseball bat. However, it should be understood that the system 100 may be configured to expand to a diameter that is smaller or larger. For example, the system 100 may be configured to expand to accommodate any industry standard bat size, any bat size permissible by the rules of baseball, softball, and/or any size set forth by governing bodies of different sports organizations. Additionally, the system 100 may be configured to fit on (e.g., to accommodate) children's bat sizes.

In an example embodiment, the plurality of panels 160 may include three panels secured in a circular formation by the collar 170. The panels 160 may be weighted, such that the panels increase the weight of the system 100. For example, each panel may weight approximately 4 ounces, such that the system 100 weighs approximately 12 ounces. When the panels 160 are placed against the barrel of the bat, the interior surface 115 of the panels 160 in contact with the bat may comprise a relatively low friction material that will not damage or bind to the surface of the barrel while the system 100 is attached to the barrel or upon removal from the bat. In some embodiments, a portion of the collar 170 may be inserted through at least one of the plurality of panels 160 such that the portion of the collar 170 may contact the barrel of a bat placed through the center opening 110 of the system 100.

FIG. 1 illustrates a perspective view of the adjustably weighted bat sleeve system 100 consistent with an embodiment of the disclosure for providing a baseball bat collar or sleeve for use with a bat (e.g., for swinging exercises and/or warm-ups). The system 100 may be embodied as a multipiece sleeve comprising the plurality of panels 160 and the collar 170. The plurality of panels 160 may include multiple individual panels 165, each of which may be a generally arcuate panel secured in a circular orientation by the annular collar 170 such that the plurality of panels 160 create or define the center opening 110. The center opening 110 may be configured to receive and removably retain a bat. In some embodiments, the center opening may define an axis along which the bat is inserted for retention.

The annual collar 170 may restrict movement of the plurality of panels 160 relative to one another. In certain embodiments of the system 100, the annular collar 170 may enable each of the panels 160 to pivot and/or flex such that the center opening 110 at a cap end 140 may be larger than the center opening 110 at a handle end 130, when a bat or similarly-shaped device is placed within the system 100.

Figure 2:
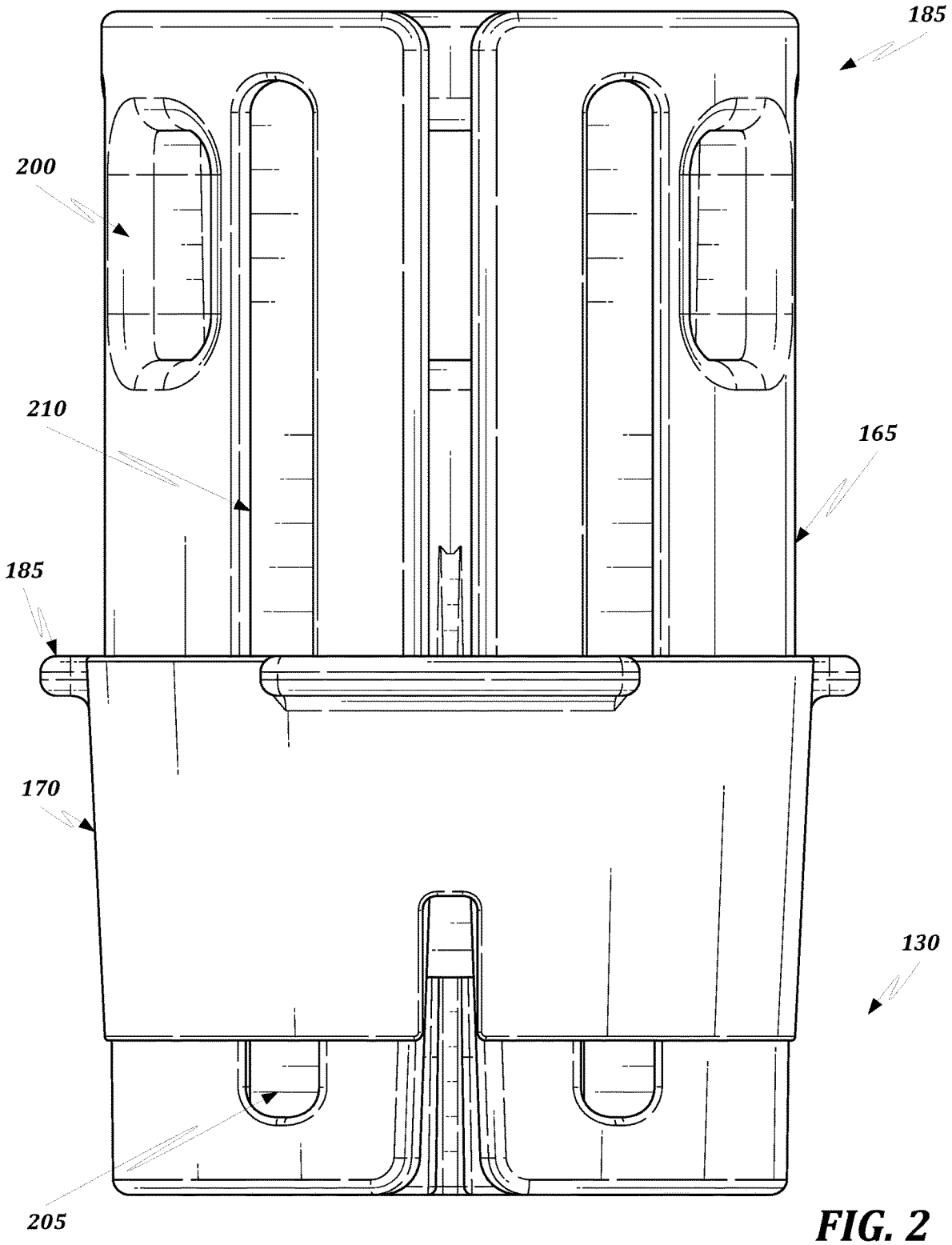
FIG. 2 is a perspective view thereof.
Figure 3:
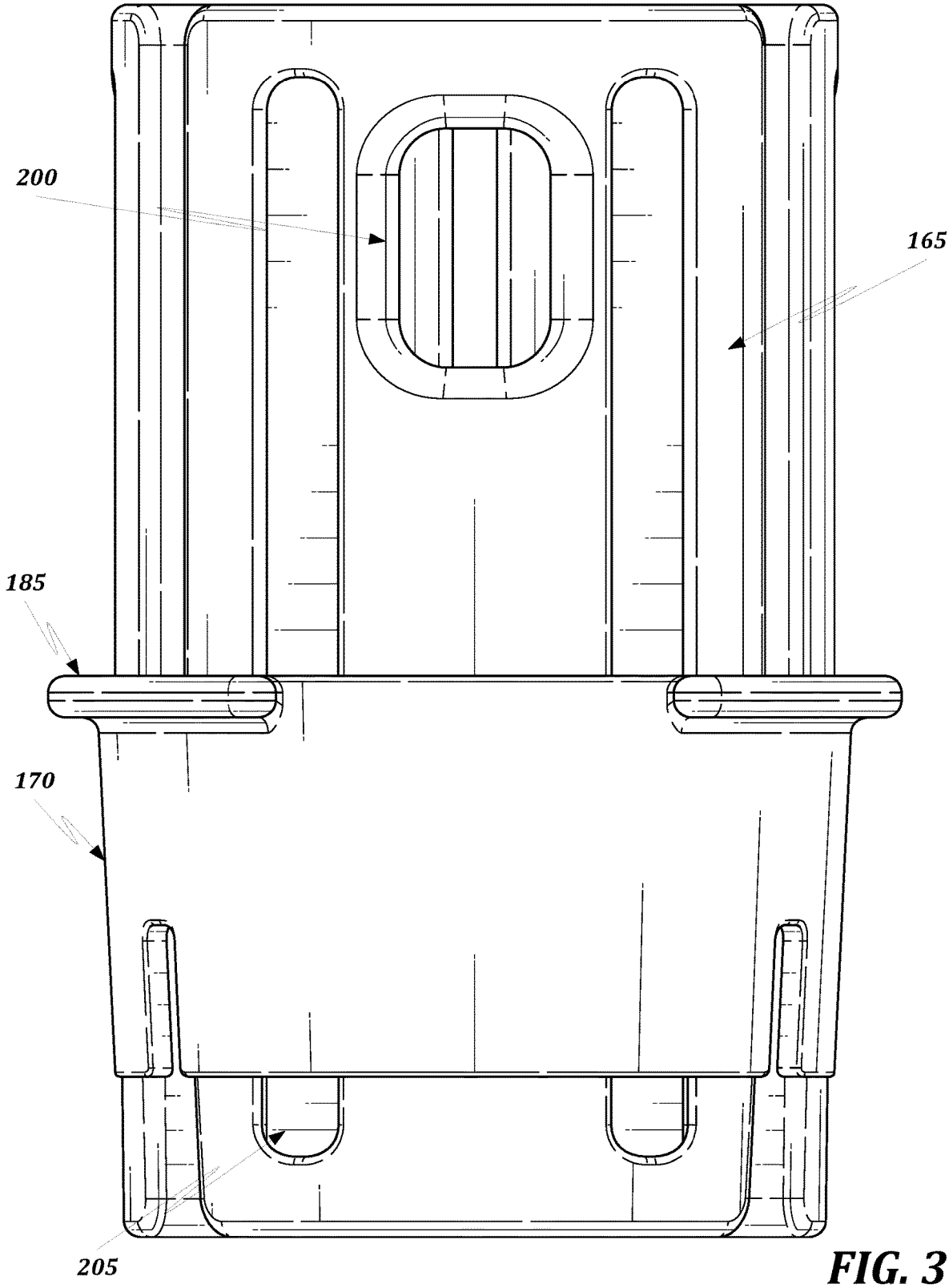
FIG. 3 is a right side view thereof.

FIG. 2 and FIG. 3 illustrate side views of the system 100 consistent with an embodiment of the disclosure for providing a baseball bat collar 170. Each of the plurality of panels 160 may comprise one or more external slots 205. One or more (e.g., each) of the one or more external slot 205 may optionally receive and retain a weighted insert 210 and/or a slot cover 220. In some embodiments, the slot 205 may extend across the annular collar 170, such that the annular collar aids in securing the weighted insert 210 and/or the slot cover 220 to the system 100. The slot 205 may be formed as an indentation that does not extend through the entire thickness of the panel.

Each panel 160 may be formed to define at least one finger hole 200. The at least one finger hole 200 may increase the leverage that can be applied by a user when removing the system 100 from the bat.

In some embodiments, the annular collar 170 may comprise a plurality of protrusions 180. The protrusions 180 may extend radially inwardly from the inner surface of the collar 170, and may be used to help provide a rotational force to the plurality of panels 160.

Figure 4:
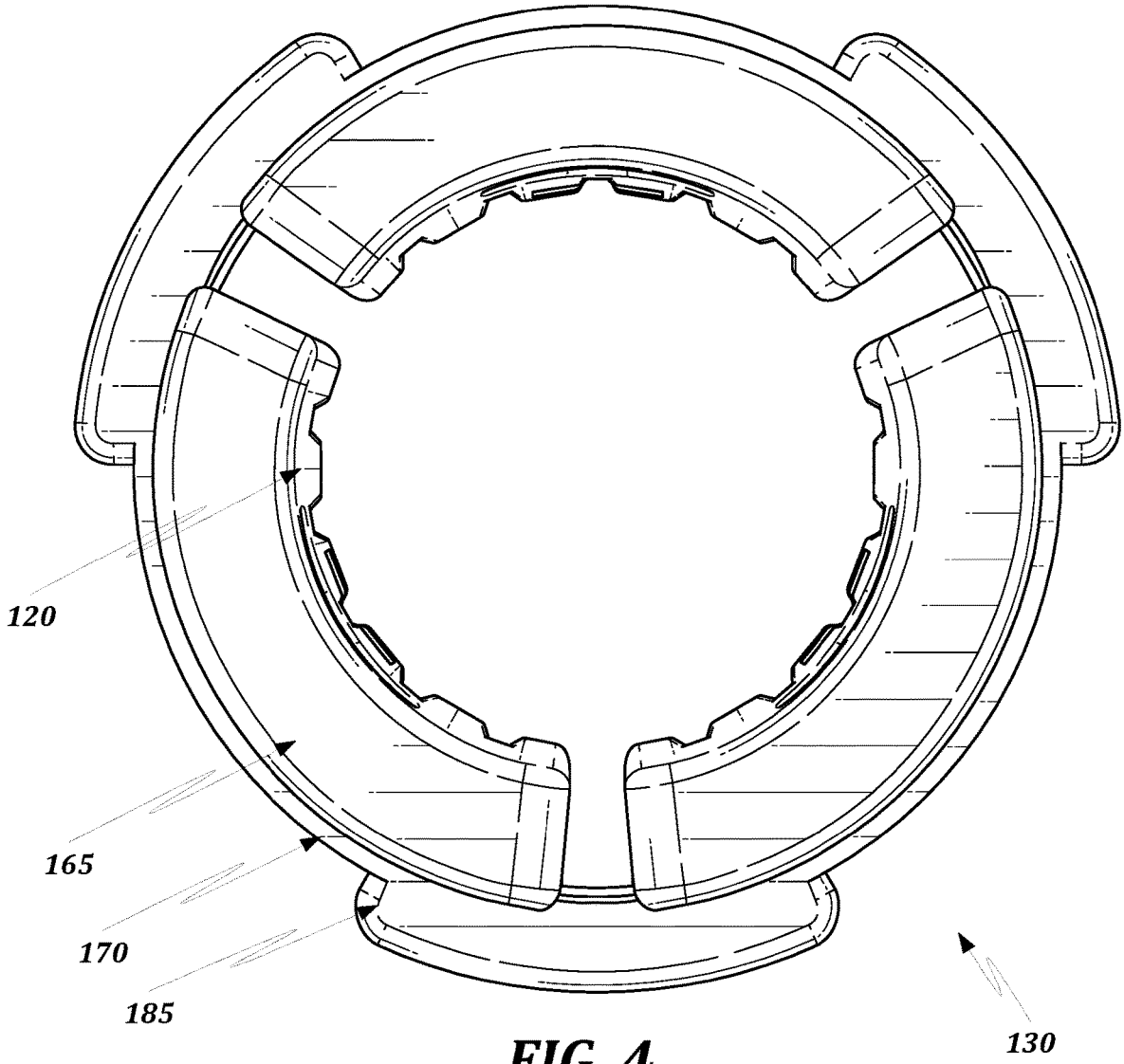
FIG. 4 is a left side view thereof.

FIG. 4 illustrates a top view of the system 100. As shown in FIG. 4, at the cap end 140 of the system 100, one or more (e.g., each) of the plurality of panels 160 may have an inner surface 115. The inner surface 115 may comprise a smooth portion (e.g., at the cap end) that transitions to a textured portion 120 at the handle end 130 of the system 100. Accordingly, the cap end 140 of the system 100 may be configured to contact the bat with a greater surface area than the handle end 130 of the system 100.

Figure 5:
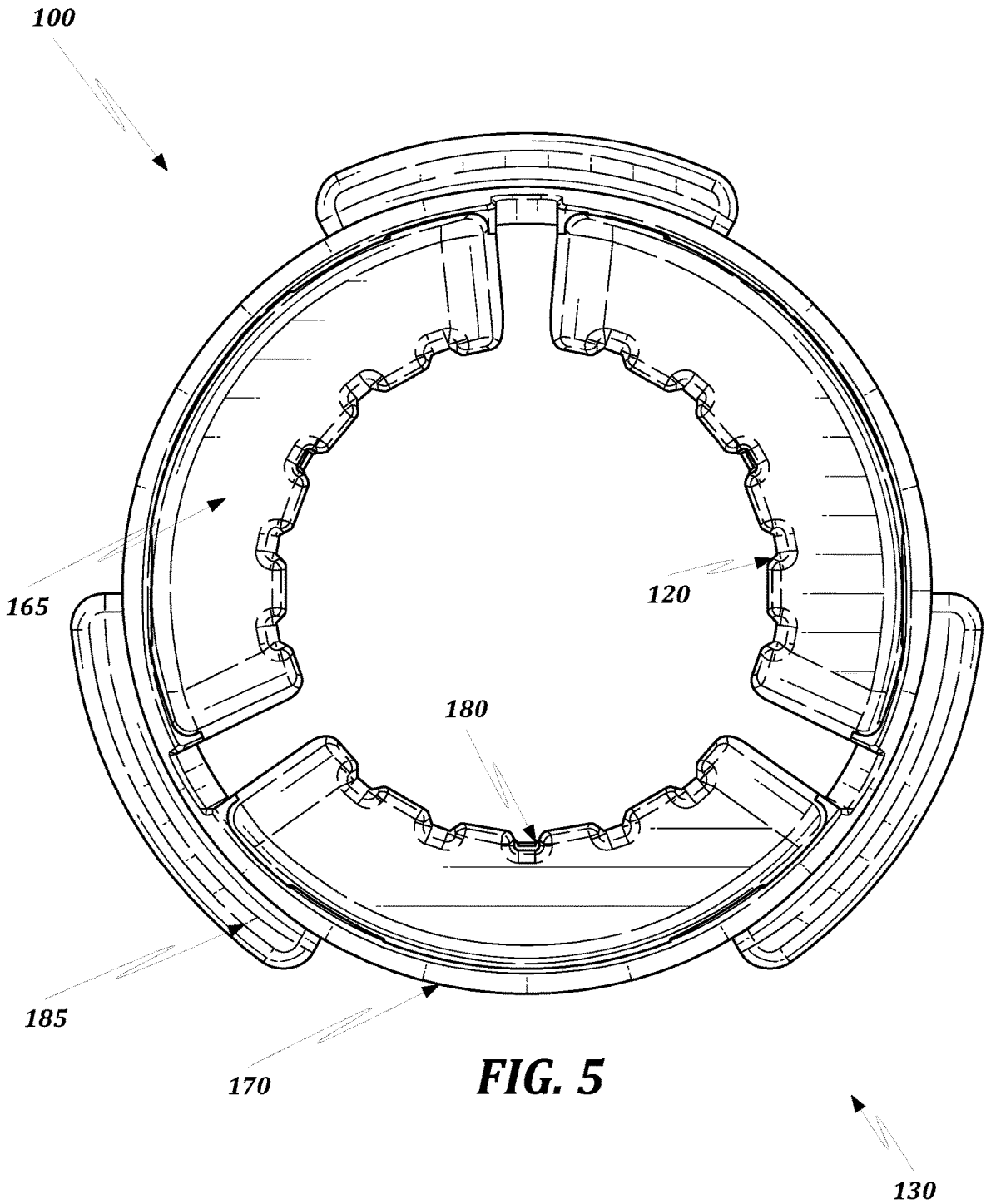
FIG. 5 is a front view thereof.

FIG. 5 illustrates a bottom view of the system 100 consistent with an embodiment of the present disclosure. As discussed above, the inner surface 115 of one or more (e.g., each) of the plurality of panels 160, at the handle end 130, may comprise a textured portion 120. The textured portion 120 may comprise a plurality of ridges or other textured elements that may transition to a smooth portion towards the cap end 140 of the baseball bat. In certain embodiments of the system 100, one or more protrusions 180 of the collar 170 may extend through a portion of each panel 165 of the plurality of panels 160 such that a portion of the collar 170 may make contact with any object placed within the center opening 110. In certain embodiments, the portion of the collar 170 that may make contact with an object placed within the center opening 110 may comprise a higher coefficient of friction than the inside surface of the plurality of panels 160. Accordingly, movement (e.g., rotation) of the collar 170 when the system 100 is attached to an object may reduce the static friction between the object and the portion of the collar 170 contacting the object. When the collar 170 releases friction between the portion of the collar 170 contacting the object (e.g., the protrusions 180), and the object may be removable from the center opening 110 more easily.

Figure 6:
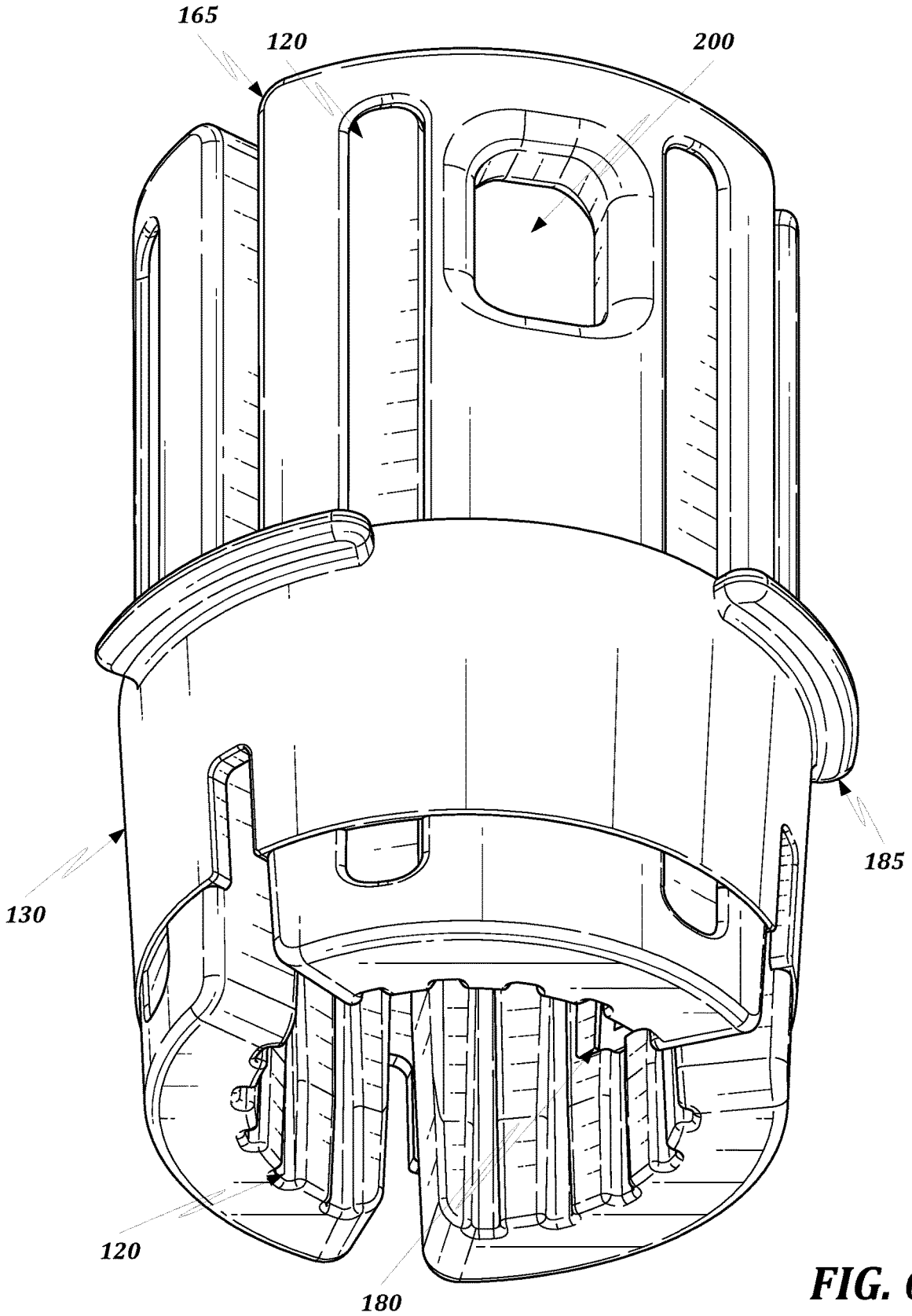
FIG. 6 is a back view thereof.

FIG. 6 illustrates another perspective view of the system 100, from the handle end 130. As discussed above, the inner surface 115 of the plurality of panels 160 may comprise a textured surface 120 at the handle end 130. The textured surface 120 may be configured to minimize the amount of contact the inner surface 115 makes with an object (e.g., a bat) inserted through the center opening 110 at the handle end 130. The textured surface 120 of the plurality of panels 160 may be configured to deform upon insertion of an object into the center opening 110. Accordingly, the textured surface 120 of each of the panels 160 may be configured to provide increased friction along the axis of the center opening 110. The textured surface 120 may also be configured to release at least a portion of the friction forces generated by the insertion of an object into the center opening 110 in response to a rotational motion orthogonal to the center opening 110 (e.g., by rotation of the collar 170). In certain embodiments of the system 100. The rotational force to release the attachment of the system 100 from the object in the center opening 110 may be less than the force required to remove the system 100 from the object along the vertical axis.

FIG. 8A and FIG. 8B illustrate a single panel 165, of the plurality of panels 160, attached to the collar 170. The protrusions 180 on the inner surface of the collar 170 may be configured to flex such that the panel 165 may be inserted over the protrusion. Upon insertion of the protrusion 180 through the panel 165, the protrusion may secure the panel 165 to the collar 170. The protrusion 180 may have a length that substantially corresponds to a thickness of the panel 165, such that the protrusion may contact an object placed within the center opening 110 of the system 100.

A. A Plurality of Panels

FIGS. 9A and 9B illustrate one panel 165 of the plurality of panels 160. In certain embodiments of the system 100, each of the panels 165 may be detachably removable from the collar 170. In embodiments, the panel 165 may be formed from or may include a deformable material, such as rubber or high-density foam.

The panel 165 may comprise an opening 195 to enable attachment to the collar 170. For example, the opening 190 may be sized to receive and releasably retain a protrusion 180 of the collar 170. In embodiments, the opening 190 may retain the protrusion 180 via a friction fit. In embodiments the panel 165 may be independently attachable to the collar 170, such that each panel 165 may be independently replaced in the system 100.

The panel 165 may comprise at least one finger hole 200 that may be used to generate sufficient leverage to remove an object inserted into the center opening 110 from the system 100. In some embodiments, the finger hole 200 may also retain additional devices for attachment to the panel 165.

In certain embodiments of the present disclosure, an external surface of the panel 165 may comprise one or more external slots 205 that may be configured to receive and retain a weighted insert 210 and/or a slot cover 220. At least one of the one or more external slots 205 may be formed as an indentation that does not extend through an entire thickness of the panel 165.

An inner surface 115 of the panel 165 may have a textured portion 120 (e.g., at the handle end 130 of the panel). In some embodiments, the textured portion 120 may include a plurality of ridges or other textured elements. The inner surface 115 may transition from the textured portion 120 to a smooth portion (e.g., towards the cap end 140 of the panel). In certain embodiments, the textured portion 130 of the inner surface 115 may extend beyond the opening 190 on the panel 165 for the protrusion 180 of the collar 170. The inner surface 115 may be formed from a relatively soft material to minimize binding, scratching, and/or damaging the barrel of the bat resulting from contact with the system 100.

In some embodiments, the panel 165 may be constructed or formed using a polymer, rubber, or other firm but semi-compressible material. Accordingly, the material used to construct the panel 165 may enable the system 100 to contact and retain an inserted object (e.g., a bat) along the axis defined by the center opening 110 of the system 100. In some embodiments of the present disclosure, the material of the panel 165 located on the interior surface of the center opening 110 may comprise a higher coefficient of friction along the axis of center opening 110 and prevents the system 100 from detaching from the object when the system 100 is in use. In certain embodiments, compression of the panel 165 (e.g., by twisting or rotational movement of the system 100) may release at least some of the force retaining the object within the center opening 110 such that the system 100 can be removed more easily.

Thus, the panel 165 may be configured to release the system 100 from the object responsive to a twisting or rotational force orthogonal to the axis defined by the center opening 110. In one example, while the system 100 may be attached and secured to a bat along a first axis extending from the handle of the bat to the cap of the bat, an orthogonal force applied to the system 100 such as a rotational force may detach the system 100 from the bat. Accordingly, the orthogonal rotation may release plurality of panels 160 enabling removal of the system 100.

B. An Annular Collar

FIG. 7A and FIG. 7B illustrates the annular collar 170. The collar 170 may comprise a plurality of internal connection protrusions 180. The protrusions 180 may extend radially inward from the collar 170, and may be used to connect the collar to the plurality of panels 160. In embodiments, the protrusions 180 may help to position the plurality of panels 160 to form the center opening 110.

The collar 170 may comprise a raised rim 185. The raised rim 185 may enable better leverage for adhering the system 100 to the inserted object (e.g., the bat). For example, the raised rim 185 may be located towards the cap end 140 of the collar 170 such that the raised rim 185 may enable force to be applied along the axis of the center opening 110 to secure the system 100 to an object inserted into the center opening 110.

The collar 170 may comprise and/or be formed from a polymer, plastic or other rigid or semirigid material such that the collar 170 may retain its shape without damaging an object inserted in the center opening 110 at points where the collar 170 contacts the bat. In embodiments, the collar 170 may restrict the movement of the plurality of panels 160 attached thereto.

In some embodiments, the collar 170 may be located at the approximate midpoint of the system 100. In other embodiments, the collar may be offset to one side (e.g., towards either the cap end 140 or the handle end 130). In embodiments where the collar 170 is offset from the midpoint of the system 100, the offset may enable the portions of the plurality of panels 160 on the opposite end of the system 100 to splay and expand to a larger diameter than the portions of the panels 160 located on the side to which the collar 170 is offset. As a nonlimiting example, the collar 170 may be offset towards the handle end 130 of the system 100 such that portions of the panels 160 at the cap end 140 may splay to a larger diameter than portions of the panels at the handle end, allowing the center opening 110 at the cap end 140 of the system 100 to have a larger diameter than the center opening 110 at the handle end 130.

In further embodiments of the present disclosure, a portion of the collar 170 (e.g., one or more of the protrusions 180) may be inserted through an opening 190 in each of the plurality of panels 160. In some embodiments, a length of the protrusion 180 may approximately match a thickness of the panel 160, such that, when inserted into the panel, an innermost surface of the protrusion 180 is approximately flush with an inner surface of the panel. Accordingly, the collar 170 and the protrusions 180 connecting the plurality of panels 160 to the system 100 may enable the plurality of panels 160 to contact and retain the system 100 to object by restricting the movement of the panels 160.

C. A Weighted Insert

In some embodiments, the system 100 may optionally comprise one or more weighted inserts. Each of the weighted inserts may be formed from metal, composite, and/or any other durable and relatively heavy material. In some embodiments, the one or more inserts may be configured to adjust the total weight of the system 100 to be a specific weight. For example, the total weight may be 24 ounces. As a specific example, the system 100, without the weighted inserts, may weigh 16 ounces; the system may comprise six panels, 160, and each panel may have one external slot 105 for a weighted insert. In embodiments, the weighted inserts may be available in various different weights (e.g., between about 0.5 ounces and about 2 ounces, or in another weight range that is helpful for swing training). In some embodiments, the weighted inserts may be colored. The color of the insert may correspond, for example, to the insert weight, such that the inserts are easily identifiable. Alternatively, the color may be completely cosmetic, for use in customizing the appearance of the system 100.

Figure 10:
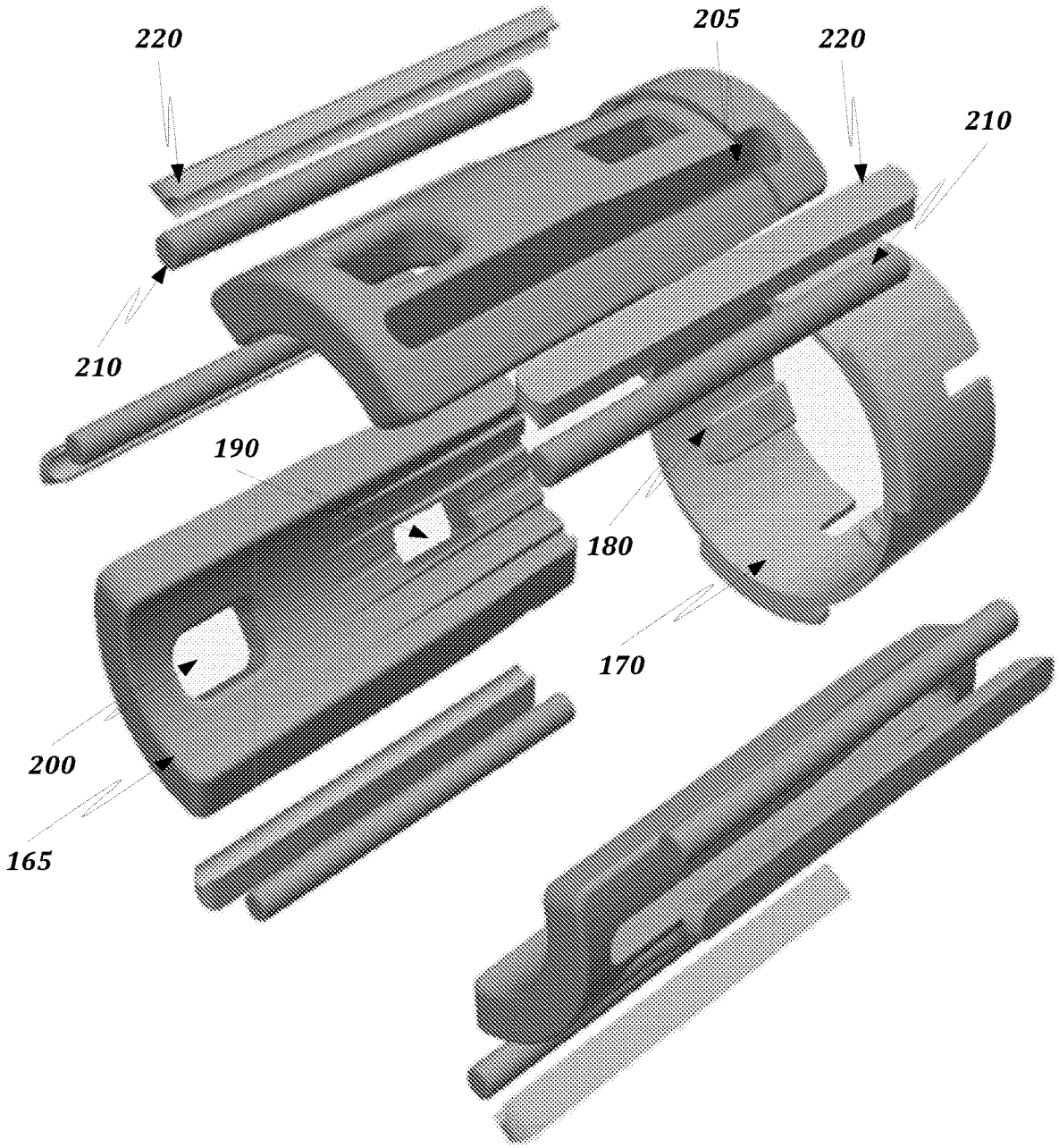
FIG. 10 is an exploded view of the system.

FIG. 10 illustrates an exploded view of the system. In certain embodiments of the system, the external slots 205 may be configured to store and secure a weighted insert 210. The weighted insert 210 may be covered by a slot cover 220 to further secure the weighted insert and prevent movement of the weighted insert during use of the system.

In embodiments, the slot cover 220 may be removed from the system to expose the external slot 205. The weighted insert 210 may be placed into the external slot 205. The slot cover 220 may then be press fit to secure the weighted insert 210 within the slot 205. In certain embodiments of the system, the collar may help to secure the weighted insert 210 such that it cannot be removed during system use.

D. A Slot Cover

In some embodiments, the system 100 may optionally comprise one or more slot covers 220. In some embodiments, the slot cover 220 may be formed to cover an external slot 205 or aperture in a panel 165. In other embodiments, the slot cover 220 may be configured to cover the external slot 205, a finger hole 200, or any other slot or aperture in the panel 165. In some embodiments, the slot cover 220 may be colored. The color of the slot cover 220 may be purely cosmetic (e.g., matching a user's team colors, matching a favorite color of a user), may serve to identify the system as belonging to the user (e.g., the user may use a unique color or combination of colors to identify the system), and/or may serve other purposes.

E. A Computer Sensing Device

Figure 11:
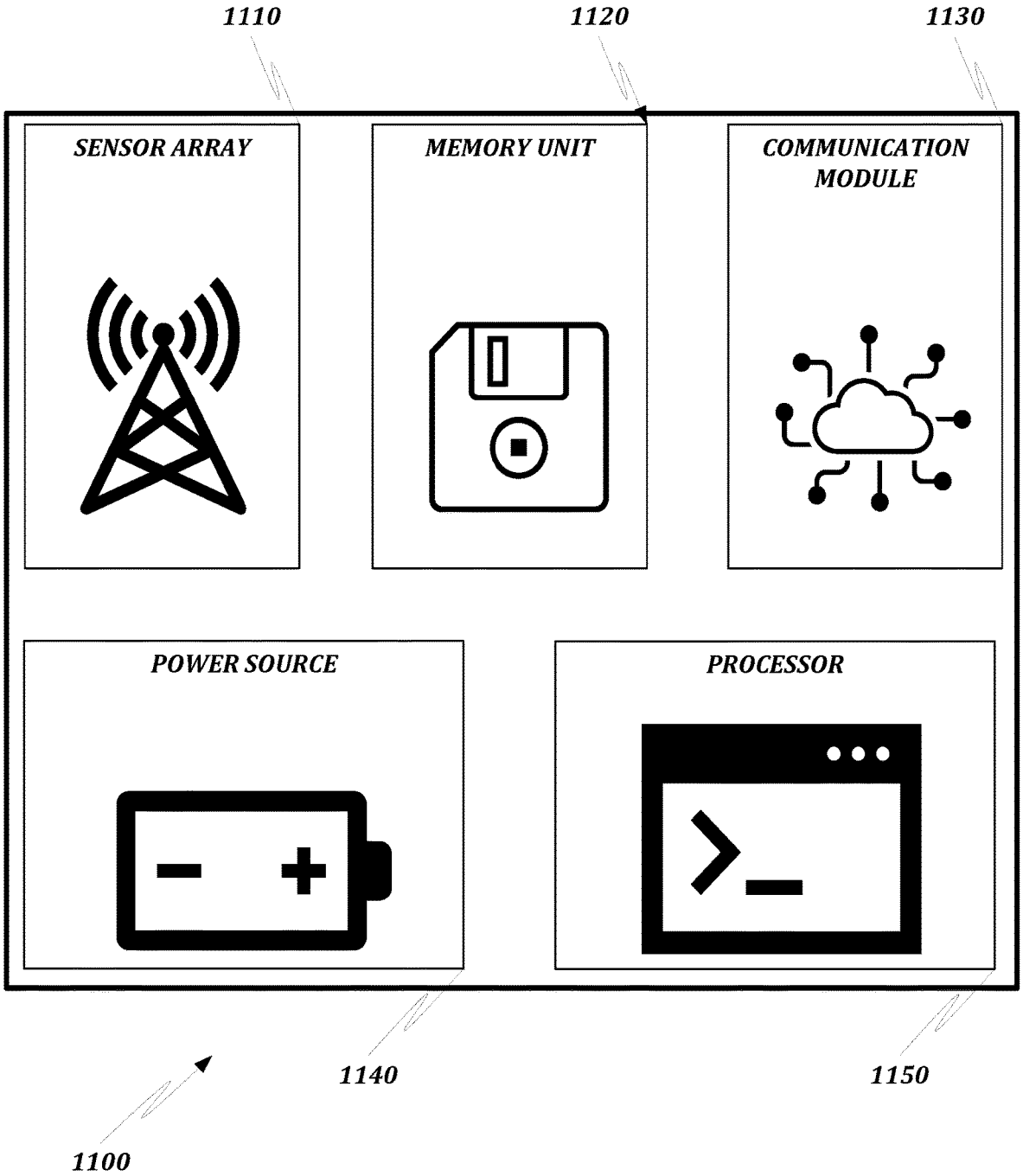
FIG. 11 is a block diagram for one embodiment of the computer sensing device.

In some embodiments, the system 100 may optionally comprise a computer sensing device 1100. FIG. 11 illustrates one possible embodiment of the computer sensing device 1100. In some embodiments, the sensing device 1100 may be embedded into the collar 170 and/or one or more of the plurality of panels 160, or may be attached to the system 100 by insertion at an external slot 205 (e.g., a slot in a panel 165). For example, the sensing device 1100 may be inserted into a finger hole 200.

The computer sensing device 1100 may comprise an array 1110 of one or more sensors configured to capture data relating to usage of the system. The array 1110 may be configured to sense position, velocity, and/or acceleration data relating to the movement of a bat during at least a portion of the time that the system 100 is attached to the bat. In some embodiments of the present disclosure the sensing device 1100 may be connected to other computing devices (e.g., via wired and/or wireless communication module 1130) to relay the captured information for display. In some embodiments, the captured information may be relayed substantially in real time. Alternatively or additionally, the captured information may be stored in the sensing device 1100 and transferred to one or more other devices at a later time.

In some embodiments of the system, the sensing device may comprise a processor 1150 that may analyze at least part of the data captured by the sensor array 1110. The device 11000 may comprise a memory unit 1120 to store the data captured by the sensor array 1110 and or the processed data from the processor 1150. The sensing device 1100 may comprise a power source 1140, such as a rechargeable battery, to power various components of the sensing device (e.g., the sensor array 1110, the memory unit 1120, the communication module 1130, and/or the processor 1140).

In embodiments, the sensor array 1110 and the processor 1150 may be configured to measure data associated with the system (e.g., positional data, orientation data, velocity data, acceleration data, etc.). Each of the one or more sensors in the sensor array 1110 may be in operative communication with the processor 1150. The processor 1150 may process the data received from the sensors. The processor 1150 and/or the sensor array 1110 may be connected to a memory unit 1120 configured to store the sensor data and/or the processed sensor data.

In some embodiments, the processor 1150 and/or the sensor array 1110 may be connected to a communication module 1130 for use in transmitting data to and/or receiving data from other computing devices. In some embodiments, the communication module 1130 may include one or more data busses for connecting the computer sensing device 1100 to another computing device. Additionally or alternatively, communication module 1130 may include one or more antennas for wirelessly connecting the sensing device 1100 to the one or more other computing devices.

In some embodiments, the communication module 1130 may include one or more interface devices for providing data in real time (or substantially real time) to a user. As a particular example, the computer sensing device 1100 may include a display and/or a speaker configured to produce visual and/or audible feedback based on a user's swing. Specifically, the computer sensing device 1100 may produce light and/or sound to indicate swing speed.

III. SYSTEM OPERATION

Embodiments of the present disclosure provide a system for affixing to an object, such as a baseball bat, softball bat, or the like, for swing training and/or analysis. The following depicts an example of at least one method of a plurality of methods that may be performed using the system. Various hardware components may be used at the various stages of operations disclosed with reference to each module.

For example, although methods may be described to be performed by a single component, it should be understood that, in some embodiments, different operations may be performed by different components.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

A. Method of Using Bat Collar

Consistent with embodiments of the present disclosure, a method may be performed by at least one of the aforementioned modules. The method may be embodied as, for example, but not limited to, computer instructions, which when executed, perform the method.

The following depicts an example of a method of a plurality of methods that may be performed by the aforementioned system, or components thereof. Various hardware components may be used at the various stages of operations disclosed.

Figure 12:
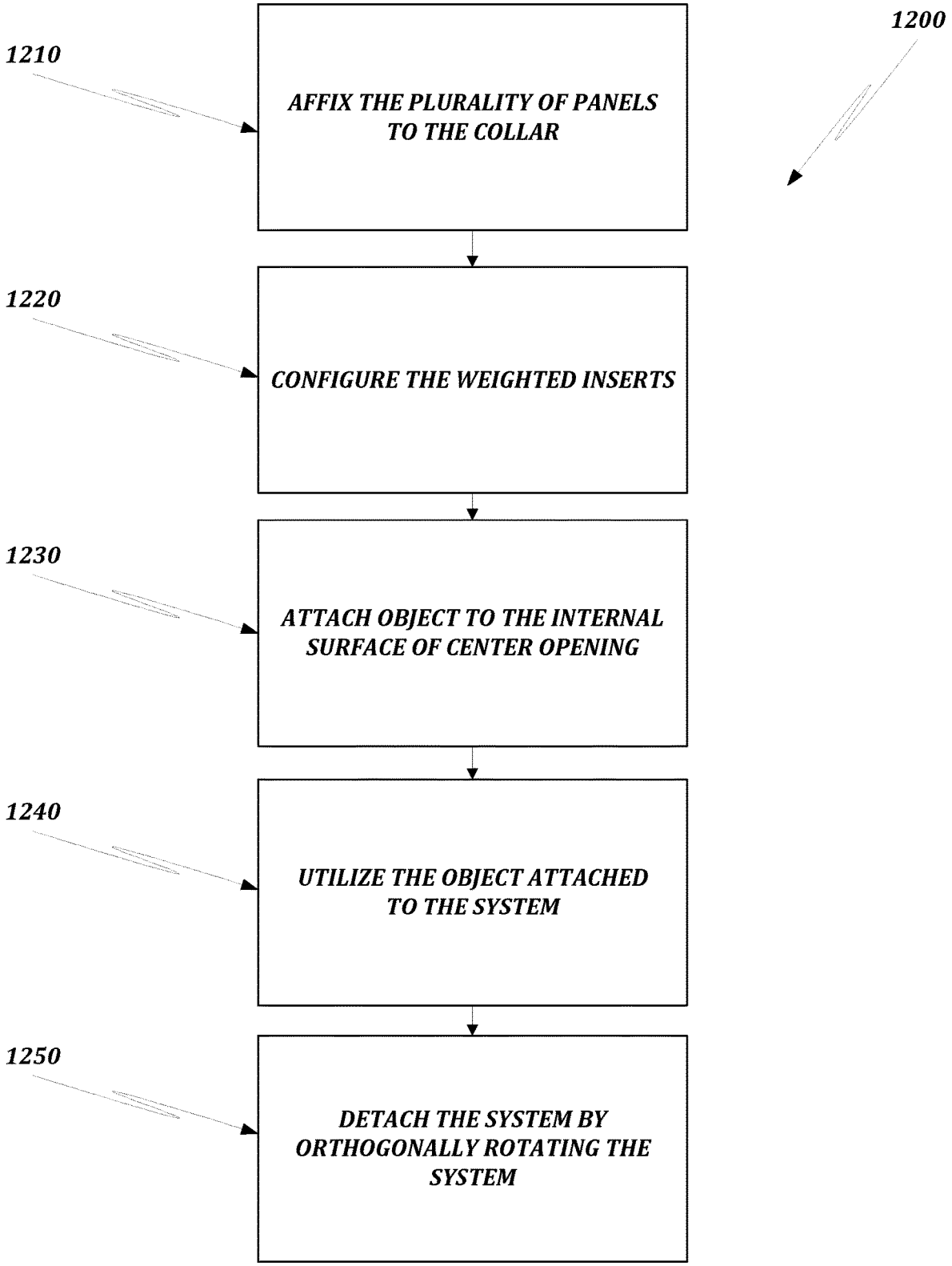
FIG. 12 is a flow chart illustrating one possible method of use for the system.

FIG. 12 is a flow chart setting forth the general stages involved in a method 1200 consistent with an embodiment of the disclosure for using the bat collar system 100. For illustrative purposes alone, the system 100 is described as one potential actor in the following stages.

The method 1200 may being at stage 1210, where a user may assemble the system. Assembling the system may include, for example, affixing panels to a collar of the system. In certain embodiments of the system 100, the panels may be affixed to the collar such that the opening 190 on each panel 165 receives a protrusion 180 to detachably secure each panel 165 of the plurality of panels 160 to the annular collar 170.

The method 1200 may then proceed to the optional stage 1220 of inserting one or more add-ons into at least one panel 165. In some embodiments, inserting the one or more add-ons may include inserting at least one weighted insert 210 into an external slots 205 on the panel 165. In certain embodiments of the system 100, the weighted insert 210 may be inserted into at least one panel 165. Of the plurality of panels 160. In certain embodiments of the present disclosure, stage 1220 may further include the weighted insert 210 being secured behind a slot cover 220 and/or behind the collar 170.

In certain embodiments of the system, stage 1220 may include inserting a computer sensing device 1100 into the external slots 205 and/or one or more of the finger holes 200.

In stage 1230, an object may be inserted into the center opening 110 of the system. In certain embodiments of the system, the object inserted may be a bat, such as a baseball bat. The bat may be inserted such that the handle end 130 of the system is closest to the handle of the bat. A force may then be applied to the system to secure the system to the inserted object. The force may be applied onto the collar of the system, or the force associated with the insertion of the object into the system may be sufficient to attach the system to the object. In some embodiments, applying the force may correspond to swinging the bat, such that a centripetal force from the swinging motion applies force to the system.

In stage 1240, the system may be used to for practice swings by swinging the inserted object. In certain embodiments of the system, the computer sensing device may be configured to capture data associated with the swinging of the bat such as movement, timing, and/or velocity data. In certain embodiments of the present disclosure, the data captured by the computer sensing device may automatically transmit to a device that can analyze and store the collected data. In other embodiments of the present disclosure, the computer sensing device may need to be removed from the system 100 before the collected data can be exported from the computer sensing device.

In stage 1250, upon finishing use of the bat or other object inserted into the system 100, the inserted object may be removed from the center opening 110 of the system. In certain embodiments of the present disclosure, a twisting or rotational motion applied to the collar 170 may disengage the attachment between the system 100 and the inserted object. The twisting motion may be orthogonal to the axis of the center opening. The orthogonal rotation may eliminate forces securing the system to the inserted object along the axis of the center opening 110. The rotational motion may be sufficient to remove the inserted object without requiring an impact force (e.g., slamming the object on the ground) to break the attachment between the object and the system 100.

IV. ASPECTS

The following disclose various Aspects of the present disclosure. The various Aspects are not to be construed as patent claims unless the language of the aspect 1 appears as a patent claim. The Aspects describe various non-limiting embodiments of the present disclosure.

Aspect 1. A system comprising:

- an annular collar includes a plurality of protrusions extending radially inwardly from an interior surface of the collar;
- a plurality of panels attached to the collar, wherein the interior of the plurality of panels define a center opening;
- wherein each panel of the plurality of panels comprises:
  - an external slot configured to releasably secure a weighted insert to the panel; and
  - an opening configured to receive a protrusion, of the plurality of protrusions, such that an interior portion of the protrusion is substantially flush with an interior surface of the panel;
- wherein the collar is configured to restrict movement of the plurality of panels relative to one another when an object is inserted along the axis of the center opening of the system; and
- wherein the interior surfaces of the plurality of panels are configured to contact and retain the object by a friction fit, and
- the protrusion is configured to separate the panel from the object in response to an orthogonal rotation of the collar relative to the axis of the center opening.

Aspect 2. The system of Aspect 1, wherein the plurality of panels further comprise a ridged interior surface.

Aspect 3. The system of Aspect 1, wherein the ridged surface transitions to a smooth surface from the handle end of the system to the cap end of the system.

Aspect 4. The system of Aspect 1, wherein the interior surface of each of the plurality of panels is constructed by foam, rubber, or compressible material.

Aspect 5. The system of Aspect 1, wherein the additional weight secured in the external slots on the plurality of panels can increase the weight of the system to 30 ounces.

Aspect 6. The system of Aspect 1, wherein the additional weight secured in the external slots on the plurality of panels can change the weight of the system from 16 ounces to 24 ounces.

Aspect 7. The system of Aspect 1, wherein the system comprises finger holes configured to house sensors to capture movement data of the system, the movement data comprising at least one of position, speed, velocity, and acceleration data of the system.

Aspect 8. The system of Aspect 1, wherein the annular collar is made of a polymer material.

Aspect 9. The system of Aspect 1, wherein the plurality of panels are modularly independent such that each panel can be removed from the collar without removing the entire plurality of panels.

Aspect 10. The system of Aspect 8, wherein the collar is offset from the midpoint of the plurality of panels such that the plurality of panels may splay such that the diameter of the center opening is larger at the cap end of the system than the handle end of the system.

Aspect 11. A system comprising:

- an annular collar includes a plurality of protrusions extending radially inwardly from an interior surface of the collar;
- a plurality of panels attached to the collar, wherein the interior of the plurality of panels define a center opening;
- wherein each panel of the plurality of panels comprises:
  - an external slot configured to releasably secure a weighted insert to the panel; and
  - an opening configured to receive a protrusion, of the plurality of protrusions, such that an interior portion of the protrusion is substantially flush with an interior surface of the panel;
- wherein the collar is configured to restrict movement of the plurality of panels relative to one another and
- wherein the interior surfaces of the plurality of panels are configured to contact and retain an object inserted along the axis of the center opening of the system by a friction fit, and the portion of the collar configured to release the friction fit from the object though orthogonal rotation of the system relative to the axis of the center opening.

Aspect 12. The system of Aspect 11, wherein the plurality of panels further comprise a ridged interior surface.

Aspect 13. The system of Aspect 11, wherein the ridged surface transitions to a smooth surface from the handle end of the system to the cap end of the system.

Aspect 14. The system of Aspect 11, wherein the interior surface of each of the plurality of panels is constructed by foam, rubber, or compressible material.

Aspect 15. The system of Aspect 11, wherein the additional weight secured in the external slots on the plurality of panels can increase the weight of the system to 30 ounces.

Aspect 16. The system of Aspect 11, wherein the additional weight secured in the external slots on the plurality of panels can change the weight of the system from 16 ounces to 24 ounces.

Aspect 17. The system of Aspect 11, wherein the system comprises finger holes to increase leverage generated from the orthogonal rotation.

Aspect 18. The system of Aspect 11, wherein the annular collar is made of a polymer material.

Aspect 19. The system of Aspect 11, wherein the plurality of panels are modularly independent such that each panel can be removed from the collar without removing the entire plurality of panels.

Aspect 20. The system of Aspect 11, wherein the collar is offset from the midpoint of the plurality of panels such that the plurality of panels may splay such that the diameter of the center opening is larger at the cap end of the system than the handle end of the system.

V. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The invention claimed is:

1. A system comprising:

an annular collar including a plurality of protrusions extending radially inwardly from an interior surface of the annular collar;

a plurality of panels, wherein the annular collar slidably receives the plurality of panels, and wherein an interior surface of each of the plurality of panels forms a center opening therebetween; and wherein each panel of the plurality of panels comprises:

an external slot configured to releasably secure a weighted insert to each panel; and an opening configured to receive one of the protrusions, of the plurality of protrusions, such that an interior portion of each protrusion is substantially flush with an interior surface of each panel;

wherein the annular collar is configured to restrict movement of the plurality of panels relative to one another when a sports implement is inserted along the axis of the center opening formed by the plurality of panels; and wherein the interior surfaces of the plurality of panels are configured to contact and retain the sports implement by a friction fit, and the interior surfaces of the plurality of panels are configured to separate the plurality of panels from the sports implement in response to an orthogonal rotation of the annular collar relative to the axis of the center opening formed by the plurality of panels.

2. The system of claim 1, wherein the plurality of panels further comprise a ridged interior surface.

3. The system of claim 2, wherein the ridged surface transitions to a smooth surface from a handle end of the system to a cap end of the system.

4. The system of claim 1, wherein the interior surface of each of the plurality of panels is constructed by foam, rubber, or a compressible material.

5. The system of claim 1, further comprising one or more additional weights securable in the external slots on the plurality of panels.

6. The system of claim 5, wherein the one or more additional weights are securable in the external slots on the plurality of panels to change the weight of the system from 16 ounces to 24 ounces.

7. The system of claim 1, wherein the system comprises a cavity configured to house one or more sensors configured to capture movement data associated with the system, the movement data comprising at least one of position, speed, velocity, and acceleration data.

8. The system of claim 1, wherein the annular collar is made of a polymer material.

9. The system of claim 1, wherein the plurality of panels are modularly independent such that each panel, of the plurality of panels, can be removed from the collar without removing the entire plurality of panels.

10. The system of claim 1, wherein the collar is offset from the midpoint of the plurality of panels, such that the plurality of panels splays such that a diameter of the center opening is larger at a cap end of system than a handle end of the system.

11. A system comprising:

an annular collar including a plurality of protrusions extending radially inwardly from an interior surface of the annular collar;

a plurality of panels, wherein the annular collar slidably receives the plurality of panels, and wherein an interior surface of each of the plurality of panels forms a center opening therebetween; and wherein each panel, of the plurality of panels, comprises:

an external slot configured to releasably secure a weighted insert to each panel, and an opening configured to receive one of the protrusions, of the plurality of protrusions, such that an interior portion of each protrusion is substantially flush with an interior surface of each panel;

wherein the annular collar is configured to restrict movement of the plurality of panels relative to one another; and wherein the interior surfaces of the plurality of panels are configured to contact and retain a sports implement inserted along the axis of the center opening formed by the plurality of panels by a friction fit, and wherein the interior surfaces of the plurality of panels are configured to release the friction fit from the sports implement though orthogonal rotation of the annular collar relative to the axis of the center opening formed by the plurality of panels.

12. The system of claim 11, wherein the plurality of panels further comprise a ridged interior surface.

13. The system of claim 12, wherein the ridged surface transitions to a smooth surface from a handle end of the system to a cap end of the system.

14. The system of claim 11, wherein the interior surface of each of the plurality of panels is constructed by foam, rubber, or compressible material.

15. The system of claim 11, further comprising one or more additional weights secured in the external slots on the plurality of panels.

16. The system of claim 15, wherein the one or more additional weights are securable in the external slots on the plurality of panels to change the weight of the system from 16 ounces to 24 ounces.

17. The system of claim 11, wherein the system comprises finger holes to increase leverage generated from the orthogonal rotation.

18. The system of claim 11, wherein the annular collar is made of a polymer material.

19. The system of claim 11, wherein the plurality of panels are modularly independent such that each panel can be removed from the collar without removing the entire plurality of panels.

20. The system of claim 11, wherein the collar is offset from the midpoint of the plurality of panels such that the plurality of panels may splay such that a diameter of the center opening is larger at a cap end of the system than a handle end of the system.

* * * * *